US005778914A

United States Patent [19]

Trani

[11] Patent Number: 5,778,914

[45] Date of Patent: Jul. 14, 1998

[54] PORTABLE TELESCOPIC WEIGHTED WALKING POLE

[76] Inventor: Armando P. Trani, 1858 Williamsbridge Rd., Bronx, N.Y. 10461

[21] Appl. No.: 623,938

[22] Filed: Mar. 28, 1996

[51] Int. Cl.[6] ..... A45B 3/00

[52] U.S. Cl. ..... 135/66; 135/75; 135/72

[58] Field of Search ..... 135/65, 66, 69, 135/72, 75, 76, 37–40, 28; 482/49, 50, 107, 108, 109

[56] References Cited

U.S. PATENT DOCUMENTS

| | | | |
|---|---|---|---|
| 1,007,572 | 10/1911 | Howe | 135/76 |
| 2,157,335 | 5/1939 | Haupt | 135/75 |
| 3,456,662 | 7/1969 | Weber | 135/75 X |
| 4,154,457 | 5/1979 | Auer et al. | 280/601 |
| 4,288,102 | 9/1981 | Ramer | 280/823 |
| 4,424,987 | 1/1984 | Ryder | 280/823 |
| 4,664,373 | 5/1987 | Hait | 487/109 X |
| 4,730,632 | 3/1988 | Mace | 135/72 X |
| 4,809,725 | 3/1989 | Champigmy | 135/75 |
| 4,858,633 | 8/1989 | Yang | 135/75 X |
| 4,887,625 | 12/1989 | Archer | 135/75 |
| 5,139,040 | 8/1992 | Kelly | 135/69 |
| 5,184,989 | 2/1993 | Stanec | 482/71 |
| 5,312,308 | 5/1994 | Hamilton et al. | 482/108 X |
| 5,346,451 | 9/1994 | Miller | 482/112 |
| 5,391,131 | 2/1995 | Gordon | 482/71 |
| 5,427,130 | 6/1995 | Yang | 135/28 |
| 5,443,435 | 8/1995 | Wilkinson | 482/50 X |
| 5,449,333 | 9/1995 | Carter | 482/107 X |
| 5,495,867 | 3/1996 | Block | 135/65 |

FOREIGN PATENT DOCUMENTS

| | | | |
|---|---|---|---|
| 1212966 | 3/1960 | France | 135/76 |

*Primary Examiner*—Lanna Mai
*Attorney, Agent, or Firm*—Richard L. Miller, P.E.

[57] ABSTRACT

A portable telescopic weighted walking pole that includes a pole portion that is collapsible, telescopic, and tubular, maintaining apparatus, a weighted handle that is removably mounted and interchangeable, and handle mounting apparatus. The pole portion has a variety of lengths, so that the pole portion is length adjustable to accommodate users of different heights and can be collapsed to a small length for easy storage and transport. The maintaining apparatus maintains the pole portion at a desired length. The weighted handle is removably mounted to the pole portion, so that increased resistance is exerted on the arms of a user as the user walks and accomplishes dual-action exercising. The handle mounting apparatus removably mounts the weighted handle to the pole portion, so that the weighted handle can be interchanged with another weighted handle when desired by the user and can be removed for easy storage and transport.

20 Claims, 1 Drawing Sheet

FIG. 1
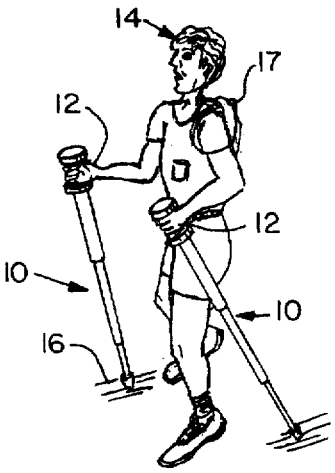
FIG. 2
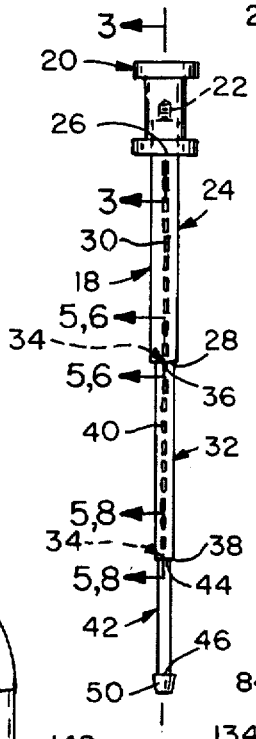
FIG. 3
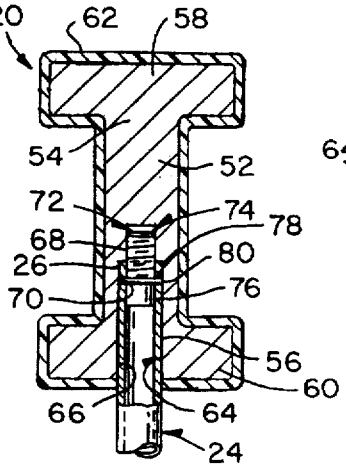
FIG. 4
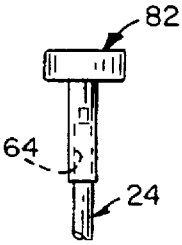
FIG. 9
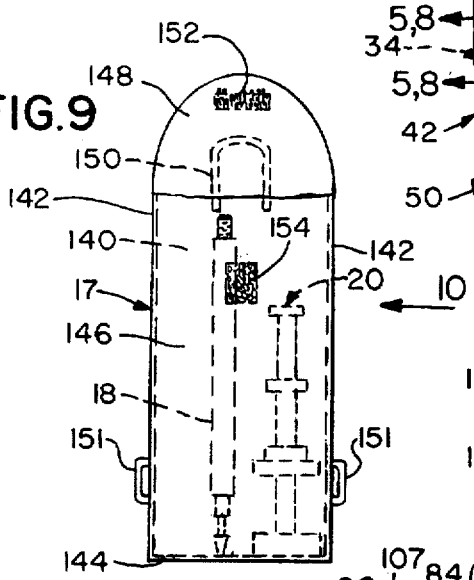
FIG. 6
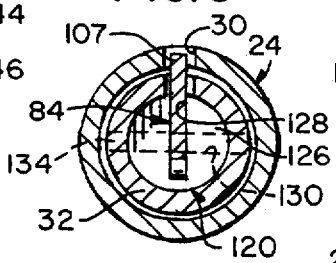
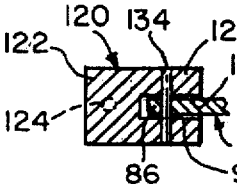
FIG. 7
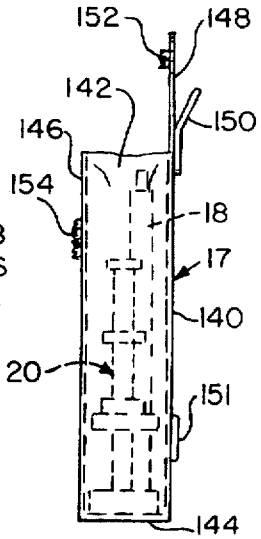
FIG. 10
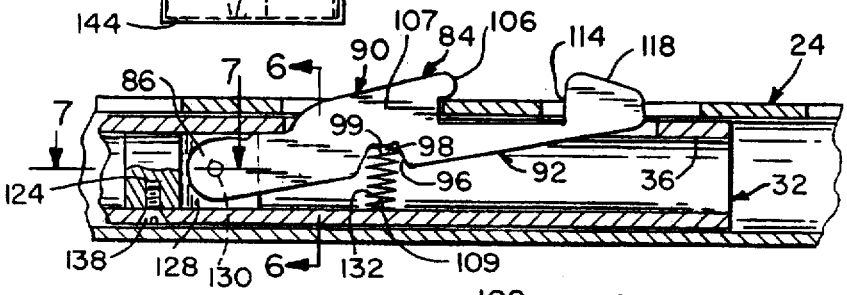
FIG. 5
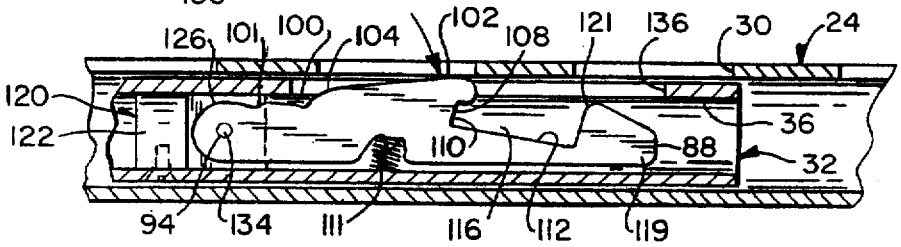
FIG. 8

PORTABLE TELESCOPIC WEIGHTED WALKING POLE

BACKGROUND OF THE INVENTION

The present invention relates to a walking pole. More particularly, the present invention relates to a portable telescopic weight walking pole.

Walking is known to be a safe and effective form of exercise. Walkers can benefit from dual action exercising. Dual action exercising includes movement of both arms and both legs as the walker moves on the ground.

In order to facilitate dual action exercising, walkers have utilized walking poles that are grabbed at one end and placed at the other end on the ground as the walker takes strides.

As the walker strides, he pushes off with the walking pole which provides a resistive force that is absorbed by the walker and adds to the exercising effort. As the walker removes the walking pole from the ground in preparation for the next stride, however, the only form of exercise resistance available is that of the weight of the pole, which is minimal.

Further, walking poles in general are particularly awkward to carry when not in use because the elongated members tend to assume divergent directions making the carrying process even more awkward.

Numerous innovations for exercising devices have been provided in the prior art that will be described. Even though these innovations may be suitable for the specific individual purposes to which they address, however, they differ from the present invention in that they do not teach a portable telescopic weight walking pole that includes a telescopic, elongated, and slender pole with a threaded end, and a weight in the form of a gripable handle that has a threaded longitudinally-disposed, and elongated aperture that is removably and threadably mounted to the threaded end of the telescopic, elongated, and slender pole.

FOR EXAMPLE, U.S. Pat. No. 4,154,457 to Auer et al. teaches a ski that includes extra weights that are stationarily disposed adjacent the longitudinal ends thereof. The extra weights are interchangeably and detachable fixed in their respective positions.

ANOTHER EXAMPLE, U.S. Pat. No. 4,288,102 to Ramer teaches a pair of ski poles. Each of the pair of ski poles has a shaft of two portions releasably connected to each other and to a unique grip. Each of the two portions of the shaft telescopic one within the other to any one of a number of predetermined positions.

STILL ANOTHER EXAMPLE, U.S. Pat. No. 4,424,987 to Ryder teaches a telescopic ski pole assembly that includes at least first and second telescopically connected elongated tubular members. The first and second first and second telescopically connected elongated tubular members are connected to each other by a pair mating flanges.

YET ANOTHER EXAMPLE, U.S. Pat. No. 5,184,989 to Stanes teaches a physical exercise system that uses conventional downhill or cross-country skis and poles in a skiing exercise system. A ski holder is attached to the end of each of the pair of skis and a plug is attached to each of the pair of ski poles.

STILL YET ANOTHER EXAMPLE, U.S. Pat. No. 5,346,451 to Miller teaches an exercise apparatus with telescoping pole pieces that includes a pair of pump poles. Each of the pair of pump poles has inner and outer telescoping tubes and an air pressurizable chamber for providing greater resistance.

FINALLY, YET STILL ANOTHER EXAMPLE, U.S. Pat. No. 5,391,131 to Gordon teaches snow ski enhancer that includes a weighted base having a front side, a back side, a left sidewall, a right sidewall, an upper surface, and a lower surface. Two hollow cylindrical vertical extensions are integral with the backside of the weighted base.

It is apparent that numerous innovations for exercising devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a portable telescopic weighted walking pole that avoids the disadvantages of the prior art.

ANOTHER OBJECT of the present invention is to provide a portable telescopic weighted walking pole that is simple and inexpensive to manufacture.

STILL ANOTHER OBJECT of the present invention is to provide a portable telescopic weighted walking pole that is simple and easy to use.

YET ANOTHER OBJECT of the present invention is to provide a portable telescopic weighted walking pole that provides dual action exercising for walkers.

STILL YET ANOTHER OBJECT of the present invention is to provide a portable telescopic weighted walking pole that increases the resistance as the walker removes the walking pole from the ground in preparation for the next stride.

YET STILL ANOTHER OBJECT of the present invention is to provide a portable telescopic weighted walking pole that is not particularly awkward to carry when not in use.

BRIEFLY STATED, STILL YET ANOTHER OBJECT of the present invention is to provide a portable telescopic weighted walking pole that includes a pole portion that is collapsible, telescopic, and tubular, maintaining apparatus, a weighted handle that is removably mounted and interchangeable, and handle mounting apparatus.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating the present invention being utilized by an exerciser;

FIG. 2 is a diagrammatic elevational view of the present invention;

FIG. 3 is an enlarged cross sectional view, with parts broken away, taken on line 3—3 in FIG. 2;

FIG. 4 is an elevational view of an alternate embodiment of the weight shown in FIG. 3;

FIG. 5 is an enlarged cross sectional view, with parts broken away, taken on line 5—5 in FIG. 2 illustrating the locking mechanism in the locked position;

FIG. 6 is a cross sectional view taken on line 6—6 in FIG. 5;

FIG. 7 is a cross sectional view, with parts broken away, taken on line 7—7 in FIG. 5;

FIG. 8 is an enlarged cross sectional view, with parts broken away, taken on line 8—8 in FIG. 2 illustrating the locking mechanism in the unlocked position;

FIG. 9 is a diagrammatic front elevational view of a carrying pouch having the dissembled components of the present invention therein that can be transported and stored; and FIG. 10 is diagrammatic side elevational view taken in the direction of arrow 10 in FIG. 9.

DETAIL DESCRIPTION OF THE PREFERRED EMBODIMENT

Referring now to the figures in which like numerals indicate like parts, and particularly to FIG. 1, the portable telescopic weighted walking pole of the present invention is shown generally at 10 being held in walker hands 12 of a walker 14 and providing in additional to the normal function of a walking pole, additional resistance as the walker 14 removes the portable telescopic weighted walking pole 10 from the ground 16 in preparation for the next stride. The walker 14 is carrying a transport and storage pouch 17 for transporting and storing the portable telescopic weighted walking pole 10.

The configuration of the portable telescopic weighted walking pole 10 can best be seen in FIG. 2, and as such, will be discussed with reference thereto.

The portable telescopic weighted walking pole 10 includes a pole portion 18 that is collapsible, telescopic, and tubular, and a weighted handle 20 that is removably mounted and interchangeable and removably mounted to the pole portion 18 by handle mounting apparatus 22.

The pole portion 18 includes an upper element 24 that is tubular and elongated and has a diameter and a proximal end 26 which is removably mounted, by the handle mounting apparatus 22, to the weighted handle 20.

The upper element 24 of the pole portion 18 further has a distal end 28.

The upper element 24 of the pole portion 18 further has a plurality of slots 30 that are elongated, longitudinally-oriented, spaced-apart, and aligned, and extend substantially from the proximal end 26 of the upper element 24 of the pole portion 18 to substantially the distal end 28 of the upper element 24 of the pole portion 18.

The portion 18 further includes an intermediate element 32 that is tubular and elongated, and has an outer diameter that is substantially equal to the inner diameter of the upper element 24 of the pole portion 18.

The intermediate element 32 of the pole portion 18 is telescopically received by the upper element 24 of the pole portion 18, and is extendable and removable therefrom, retractable therein, and maintained in relationship thereto, by pole portion maintaining apparatus 34.

The intermediate element 32 of the pole portion 18 further has a proximal end 36 which is telescopically received by the distal end 28 of the upper element 24 of the pole portion 18.

The intermediate element 32 of the pole portion 18 further has a distal end 38.

The intermediate element 32 of the pole portion 18 further has a plurality of slots 40 that are longitudinally-oriented, spaced-apart, and aligned, and extend substantially from the proximal end 36 of the intermediate element 32 of the pole portion 18 to substantially the distal end 38 of the intermediate element 32 of the pole portion 18.

The plurality of slots 40 of the intermediate element 32 of the pole portion 18 are alignable with the plurality of slots 30 of the upper element 24 of the tubular pole portion 18 so as to be cooperative therewith.

The pole portion 18 further includes a lower element 42 that is tubular and elongated, and has an outer diameter that is substantially equal to the inner diameter of the intermediate element 32 of the pole portion 18.

The lower element 42 of the pole portion 18 is telescopically received by the intermediated element 32 of the pole portion 18 and is extendable and removable therefrom, retractable therein, and maintained in relationship thereto by a pole portion maintaining apparatus that is analogous to the pole portion maintaining apparatus 34.

The lower element 42 of the pole portion 18 further has a proximal end 44 which is telescopically received by the distal end 38 of the intermediate element 32 of the pole portion 18.

The lower element 42 of the pole portion 18 further has a distal end 46.

The pole portion 18 further includes a tip 50 that is disposed on the distal end 46 of the lower element 42 of the pole portion 18.

The tip 50 of the pole portion 18 is preferably removable and replaceable and is preferably of a material that will assist in the traction of the portable telescopic weighted walking pole 10 on the ground 16.

It is to be understood, however, that the use of the upper element 24 of the pole portion 18, the intermediate element 32 of the pole portion 18, and the lower element 42 of the pole portion 18 are preferable and for illustrative purposes only and that any number of telescopic elements may be used for the pole portion 18.

The telescopic ability of the upper element 24 of the pole portion 18 relative to the intermediate element 32 of the pole portion 18 relative to the lower element 42 of the pole portion 18 allows for length adjustment of the pole portion 18 to accommodate different height walkers 14 and further allows the pole portion 13 to be collapsed to a small length for easy storage and transport.

The configuration of the weighted handle 20 and the handle mounting apparatus 22 can best be seen in FIG. 3, and as such, will be discussed with reference thereto.

The weighted handle 20 is substantially I-shaped and has a vertical portion 52 that is substantially cylindrically-shaped and has a diameter, an upper end 54, and a lower end 56.

The handle vertical portion 52 of the weighted handle 20 is preferably substantially cylindrically-shaped but may be of any shape to enhance the gripping thereof by the walker hands 12 of the walker 14.

The weighted handle 20 further has an upper horizontal portion 58 that is substantially-disk-shaped and disposed on, is integral and coaxial with, and has a diameter greater than, the upper end 54 of the vertical portion 52 of the weighted handle 20.

The upper horizontal portion 58 of the weighted handle 20 facilitates proper positioning and retention of the walker hands 12 of the walker 14 on the weighted handle 20.

If so desired, the walker 14 can grasp the weighted handle 20 with the palms of the walker hands 12 of the walker 14 on the upper horizontal portion 58 of the weighted handle 20.

The weighted handle 20 further has a lower horizontal portion 60 that is substantially-disk-shaped and disposed on, is integral and coaxial with, and has a diameter greater than, the lower end 56 of the vertical portion 52 of the weighted handle 20.

The lower horizontal portion 60 of the weighted handle 20 facilitates proper positioning and retention of the walker hands 12 of the walker 14 on the weighted handle 20.

It is to be understood that a properly modified conventional dumbbell hand weight can be used for the weighted handle 20, if so desired.

The weighted handle 20 further has an outer covering 62 that encases the entirety of the weighted handle 20.

The outer covering 62 of the weighted handle 20 is preferably resilient and non-corrosive and protects against corrosion OL the weighted handle 20 by the perspiration of the walker hands 12 of the walker 14 or by other elements while also providing a cushion for the walker hands 12 of the walker 14 when the walker grips the portable telescopic weighted walking pole 10.

The handle mounting apparatus 22 includes a throughbore 64 that is centrally-disposed and longitudinally-oriented and passes centrally and longitudinally through the lower horizontal portion 60 of the weighted handle 20 and into the vertical portion 52 of the weighted handle 20.

The throughbore 64 of the weighted handle 20 has a wide outer throughbore 66 that is centrally-disposed and longitudinally-oriented and passes longitudinally and centrally through the lower horizontal portion 60 of the weighted handle 20 and into the vertical portion 52 of the weighted handle 20.

The wide outer throughbore 66 of the throughbore 64 of the weighted handle 20 has a diameter substantially equal to the outer diameter of the upper element 24 of the pole portion 18.

The throughbore 64 of the weighted handle 20 further has a narrow threaded inner throughbore 68 that is centrally-disposed and longitudinally-oriented and disposed in the vertical portion 52 of the weighted handle 20 and has a diameter substantially equal to the inner diameter of the upper element 24 of the pole portion 18.

The narrow threaded inner throughbore 68 of the throughbore 64 of the weighted handle 20 is coaxial and in communication with, and is narrower than, the wide outer throughbore 66 of the throughbore 64 of the weighted handle 20.

The throughbore 64 of the weighted handle 20 passes centrally and longitudinally through the lower horizontal portion 60 of the weighted handle 20 and into the vertical portion 52 of the weighted handle 20 a distance sufficient to assure that as the walker hands 12 of the walker 14 exerts force on the portable telescopic walking pole 10, the weighted handle 20 will not be unintentionally broken off from the pole portion 18.

The handle mounting apparatus 22 further includes a throughbore 70 that is laterally-disposed and passes laterally through the proximal end 26 of the upper element 24 of the pole portion 18.

The handle mounting apparatus 22 further includes a plug 72 that is cylindrically-shaped and has a threaded upper portion 74 with a diameter substantially equal to the diameter of the narrow threaded inner throughbore 68 of the throughbore 64 of the weighted handle 20.

The plug 72 of the handle mounting apparatus 22 further has a lower portion 76 that is cylindrically-shaped and coaxial with the upper portion 74 of the plug 72 of the handle mounting apparatus 22.

The lower portion 76 of the plug 72 of the handle mounting apparatus 22 sits in, and has a diameter substantially equal to the inner diameter of, the proximal end 26 of the upper element 24 of the pole portion 18.

The lower portion 76 of the plug 72 of the handle mounting apparatus 22 has a throughbore 78 that is laterally-disposed and passes laterally through the lower portion 76 of the plug 72 of the handle mounting apparatus 22 and is in alignment with the throughbore 70 of the proximal end 26 of the upper element 24 of the pole portion 18.

The handle mounting apparatus 22 further includes a pin 80 that passes through the throughbore 70 of the proximal end 26 of the upper element 24 of the pole portion 18 and through the throughbore 78 of the lower portion 76 of the plug 72 of the handle mounting apparatus 22, so that the plug 72 of the handle mounting apparatus 22 is maintained in the proximal end 26 of the upper element 24 of the pole portion 18.

The use of the pin 80 of the handle mounting apparatus 22, the throughbore 78 of the lower portion 76 of the plug 72 of the handle mounting apparatus 22, and the throughbore 70 of the proximal end 26 of the upper element 24 of the pole portion 18, is preferably, however, the plug 72 of the handle mounting apparatus 22 can be maintained in the proximal end 26 of the upper element 24 of the pole portion 18 by epoxy, force fit, tack welded, or the like.

When the weighted handle 20 is threaded onto the pole portion 18, the upper portion 74 of the plug 72 of the handle mounting apparatus 22 threadably mates with the narrow threaded inner throughbore 68 of the throughbore 64 of the weighted handle 20 with the proximal end 26 of the upper element 24 of the pole portion 18 snugly received by the wide outer throughbore 66 of the throughbore 64 of the weighted handle 20.

The threadability of the upper threaded portion 74 of the plug 72 of the handle mounting apparatus 22 with the narrow threaded inner throughbore 68 of the throughbore 64 of the weighted handle 20 allows the weighted handle 20 to be interchanged with another weighted handle 20 of another weight, as desired by the walker 14.

An alternate weighted handle 82 which is an alternate embodiment of the weighted handle 20 can best be seen in FIG. 4, and as such, will be discussed with reference thereto.

The alternate weighted handle 82 is similar to the weighted handle 20 except that it does not have the lower horizontal portion 60 of the weighted handle 20 and therefore requires that the throughbore 64 of the weighted handle 20 extend further into the vertical portion 52 of the weighted handle 20 a distance sufficient to assure that as the walker hands 12 of the walker 14 exerts force on the portable telescopic walking pole 10, the weighted handle 20 will not be unintentionally broken off from the pole portion 18.

The configuration and operation of the pole portion maintaining apparatus 34 can best be seen in FIGS. 5 through 7, and as such, will be discussed with reference thereto.

As stated, supra, since the pole portion maintaining apparatus 34 for the maintaining the intermediate element 32 of the pole portion 18 in a desired position relative to the upper element 24 of the pole portion 18 is analogous to the pole portion maintaining apparatus 34 for maintaining the lower element 42 of the pole portion 18 in a desired position relative to the intermediate element 32 of the pole portion 18, for the sake of brevity only the configuration of the pole portion maintaining apparatus 34 for maintaining the intermediate element 32 of the pole portion 18 in a desired position relative to the upper element 24 of the pole portion 18, will be discussed.

The pole portion maintaining apparatus 34 has a locked position and an unlocked position and includes a detent plate 84 that is elongated and thin and has a rounded proximal end 86, a distal end 88, a first edge 90 that extends from the rounded proximal end 86 of the detent plate 84 of the pole portion maintaining apparatus 34 to the distal end 88 of the detent plate 84 of the pole portion maintaining apparatus 34, and a straight second edge 92 that extends from the rounded proximal end 86 of the detent plate 84 of the pole portion maintaining apparatus 34 to the distal end 88 of the detent plate 84 of the pole portion maintaining apparatus 34 opposite to the first edge 90 of the detent plate 84 of the pole portion maintaining apparatus 34.

The rounded proximal end 86 of the detent plate 84 of the pole portion maintaining apparatus 34 has a lateral through-bore 94.

The straight second edge 92 of the detent plate 84 of the pole portion maintaining apparatus 34 has a recess 96 that is substantially frustrum-shaped and has a projection 98 that is centrally-disposed and substantially pointed.

The recess 96 of the straight second edge 92 of the detent plate 84 of the pole portion maintaining apparatus 34 is disposed intermediate the rounded proximal end 86 of the detent plate 84 of the pole portion maintaining apparatus 34 and the distal end 88 of the detent plate 84 of the pole portion maintaining apparatus 34.

The projection 98 of the recess 96 of the straight second edge 92 of the detent plate 84 of the pole portion maintaining apparatus 34 extends outwardly from substantially the center of the narrowest and lowest point of the recess 96 of the straight second edge 92 of the detent plate 84 of the pole portion maintaining apparatus 34 to a height less than the depth of the recess 96 of the straight second edge 92 of the detent plate 84 of the pole portion maintaining apparatus 34.

The projection 98 of the recess 96 of the second edge 92 of the detent plate 84 of the pole portion maintaining apparatus 34 together with the recess 96 of the second edge 92 of the detent plate 84 of the pole portion maintaining apparatus 34 form a seat The first edge 90 of the detent plate 84 of the pole portion maintaining apparatus 34 has a straight part 100 that extends from, and is above, the rounded proximal end 86 of the detent plate 84 of the pole portion maintaining apparatus 34.

The rounded proximal end 86 of the detent plate 84 of the pole portion maintaining apparatus 34 is connected to the straight part 100 of the detent plate 84 of the pole portion maintaining apparatus 34, by a concave part 101.

The first edge 90 of the detent plate 84 of the pole portion maintaining apparatus 34 further has a straight part 102 that is slightly upwardly extending and extends from, and is above, the pole straight part 100 of the first edge 90 of the detent plate 84 of the pole portion maintaining apparatus 34.

The straight part 100 of the first edge 90 of the detent plate 84 of the pole portion maintaining apparatus 34 is connected to the straight part 102 of the first edge 90 of the detent plate 84 of the pole portion maintaining apparatus 34, by a convex part 104.

The straight part 102 of the first edge 90 of the detent plate 84 of the pole portion maintaining apparatus 34 is disposed on the first edge 90 of the detent plate 84 of the pole portion maintaining apparatus 34 in a position that is substantially opposite to the position on the straight second edge 92 of the detent plate 84 of the pole portion maintaining apparatus 34 that the recess 96 of the straight second edge 92 of the detent plate 84 of the pole portion maintaining apparatus 34 is disposed.

The first edge 90 of the detent plate 84 of the pole portion maintaining apparatus 34 further has a part 106 that is substantially semi-circular and extends downwardly in a convex configuration from the straight part 102 of the first edge 90 of the detent plate 84 of the pole portion maintaining apparatus 34.

The convex part 104 of the first edge 90 of the detent plate 84 of the pole portion maintaining apparatus 34, the straight part 102 of the first edge 90 of the detent plate 84 of the pole portion maintaining apparatus 34, and the part 106 of the first edge 90 of the detent plate 84 of the pole portion maintaining apparatus 34 together form an intermediate tongue 107.

The length of the intermediate tongue 107 of the first edge 90 of the detent plate 84 of the pole portion maintaining apparatus 34 is slightly greater than the length of each of the plurality of slots 30 of the upper element 24 of the pole portion 18.

The first edge 90 of the detent plate 84 of the pole portion maintaining apparatus 34 further has a first connecting straight part 108 that extends downwardly from the part 106 of the first edge 90 of the detent plate 84 of the pole portion maintaining apparatus 34 and forms therewith a notch 110.

The first connecting straight part 108 of the first edge 90 of the detent plate 84 of the pole portion maintaining apparatus 34 has a length slightly greater than the difference between the inner and outer diameters of the upper element 24 of the pole portion 18.

The first edge 90 of the detent plate 84 of the pole portion maintaining apparatus 34 further has a second intermediate straight part 112 that extends from the first connecting straight part 108 of the first edge 90 of the detent plate 84 of the pole portion maintaining apparatus 34.

The second intermediate straight part 112 of the first edge 90 of the detent plate 84 of the pole portion maintaining apparatus 34 is disposed below the part 106 of the first edge 90 of the detent plate 84 of the pole portion maintaining apparatus 34.

The first edge 90 of the detent plate 84 of the pole portion maintaining apparatus 34 further has a second connecting straight part 114 that extends upwardly from the second intermediate straight part 112 of the first edge 90 of the detent plate 84 of the pole portion maintaining apparatus 34.

The length of the second connecting straight part 114 of the first edge 90 of the detent plate 84 of the pole portion maintaining apparatus 34 is greater than the difference between the inner and outer diameters of the upper element 24 of the pole portion 18.

The first connecting straight part 108 of the first edge 90 of the detent plate 84 of the pole portion maintaining apparatus 34, the second intermediate straight part 112 of the first edge 90 of the detent plate 84 of the pole portion maintaining apparatus 34, and the second connecting straight part 114 of the first edge 90 of the detent plate 84 of the pole portion maintaining apparatus 34 together define a recess 116 that opens into, and is communication with, the notch 110 of the first edge 90 of the detent plate 84 of the pole portion maintaining apparatus 34.

The length of the recess 116 of the first edge 90 of the detent plate 84 of the pole portion maintaining apparatus 34 is greater than the distance between adjacent ones of the plurality of slots 30 of the upper element 24 of the pole portion 18 by an amount substantially equal to the radius of curvature of the part 106 of the first edge 90 of the detent plate 84 of the pole portion maintaining apparatus 34.

The first edge 90 of the detent plate 84 of the pole portion maintaining apparatus 34 further has a straight part 118 that is lightly downwardly extending and extends slightly downwardly from the second connecting straight part 114 of the first edge 90 of the detent plate 84 of the pole portion maintaining apparatus 34 to the distal end 88 of the detent plate 84 of the pole portion maintaining apparatus 34.

The straight part 118 of the first edge 90 of the detent plate 84 of the pole portion maintaining apparatus 34 is connected to the second connecting straight part 114 of the first edge 90 of the detent plate 84 of the pole portion maintaining apparatus 34, by a convex part 121.

The second connecting straight part 114 of the first edge 90 of the detent plate 84 of the pole portion maintaining apparatus 34, the straight part 118 of the first edge 90 of the detent plate 84 of the pole portion maintaining apparatus 34, and the distal end 88 of the detent plate 84 of the pole portion maintaining apparatus 34 together define a distal tongue 119.

The length of the distal tongue 119 of the first edge 90 of the detent plate 84 of the pole portion maintaining apparatus 34 is less than the length of each of the plurality of slots 30 of the upper element 24 of the pole portion 18.

The pole portion maintaining apparatus 34 further includes a yoke 120 that is cylindrically-shaped and has a first part 122 that is cylindrically-shaped and has an aperture 124 that is laterally-disposed.

The yoke 120 of the pole portion maintaining apparatus 34 further has a pair of extensions 126 that are spaced-apart and substantially semi-circular-shaped and define therebetween a throughslot 128.

The extensions 126 of the yoke 120 of the pole portion maintaining apparatus 34 has a throughbore 130 that is laterally-disposed and extends aligningly through the pair of extensions 126 of the yoke 120 of the pole portion maintaining apparatus 34.

The pair of extensions 126 of the yoke 120 of the pole portion maintaining apparatus 34 extend longitudinally from the first part 122 of the yoke 120 of the pole portion maintaining apparatus 34, with their curved sides in alignment with the outer surface of the first part 122 of the yoke 120 of the pole portion maintaining apparatus 34.

The pole portion maintaining apparatus 34 further includes a spring 132 that sits in, and extends outwardly from, the seat 99 of the recess 96 of the straight second edge 92 of the detent plate 84 of the pole portion maintaining apparatus 34.

The spring 132 of the pole portion maintaining apparatus 34 surrounds, and is assisted in maintaining its position by, the projection 98 of the recess 96 of the straight second edge 92 of the detent plate 84 of the pole portion maintaining apparatus 34.

The rounded proximal end 86 of the detent plate 84 of the pole portion maintaining apparatus 34 sits in the throughslot 128 of the yoke 120 of the pole portion maintaining apparatus 34 with the throughbore 130 of the pair of extensions 126 of the yoke 120 of the pole portion maintaining apparatus 34 in alignment with the lateral throughbore 94 of the rounded proximal end 86 of the detent plate 84 of the pole portion maintaining apparatus 34.

The pole portion maintaining apparatus 34 further includes a pivot pin 134 that passes through the throughbore 130 of the pair of extensions 126 of the yoke 120 of the pole portion maintaining apparatus 34 and the lateral throughbore 94 of the rounded proximal end 86 of the detent plate 84 of the pole portion maintaining apparatus 34.

The pivot pin 134 of the pole portion maintaining apparatus 34 pivotally mounts the detent plate 84 of the pole portion maintaining apparatus 34 to the yoke 120 of the pole portion maintaining apparatus 34.

The pole portion maintaining apparatus 34 further includes a slot 136 that is elongated and longitudinally-oriented.

The length of the slot 136 of the proximal end 36 of the intermediate element 32 of the pole portion 18 is greater than the distance from the convex part 104 of the first edge 90 of the detent plate 84 of the pole portion maintaining apparatus 34 to the distal end 88 of the detent plate 84 of the pole portion maintaining apparatus 34.

The yoke 120 of the pole portion maintaining apparatus 34 is disposed in the intermediate element 32 of the pole portion 18 inward of the slot 136 of the proximal end 36 of the intermediate element 32 of the pole portion 18 with the intermediate tongue 107 of the first edge 90 of the detent plate 84 of the pole portion maintaining apparatus 34 and the distal tongue 119 of the first edge 90 of the detent plate 84 of the pole portion maintaining apparatus 34 biased into the slot 136 of the proximal end 36 of the intermediate element 32 of the pole portion 18, by the spring of -the pole portion maintaining apparatus 34.

The end of the spring 132 of the pole portion maintaining apparatus 34 opposite the end of the spring 132 of the pole portion maintaining apparatus 34 that sits in the seat 99 of the recess 96 of the straight second edge 92 of the detent plate 84 of the pole portion maintaining apparatus 34 sits on a seat 109.

The seat 109 is disposed on the inner surface of the intermediate element 32 of the pole portion 18 opposite to the slot 136 of the proximal end 36 of the intermediate element 32 of the pole portion 18.

The seat 109 of the inner surface of the intermediate element 32 of the pole portion 18 is substantially in alignment with the seat 99 of the recess 96 of the straight second edge 92 of the detent plate 84 of the pole portion maintaining apparatus 34.

The distance from the pivot pin 134 of the pole portion maintaining apparatus 34 to the seat 99 of the recess 96 of the straight second edge 92 of the detent plate 84 of the pole portion maintaining apparatus 34 is substantially equal to the distance from the pivot pin 134 of the pole portion maintaining apparatus 34 to the seat 109 of the inner surface of the intermediate element 32 of the tubular pole portion 18.

The spring 132 of the pole portion maintaining apparatus 34 surrounds, and is assisted in maintaining its position in the seat 109 of the inner surface of the intermediate element 32 of the pole portion 18, by a projection 111 that is centrally-disposed and substantially pointed.

The yoke 120 of the pole portion maintaining apparatus 34 is maintained in the intermediate element 32 of the pole portion 18 inward of the slot 136 of the proximal end 36 of the intermediate element 32 of the pole portion 18, by a screw 138.

The screw 138 of the yoke 120 of the pole portion maintaining apparatus 34 passes through a lateral aperture in the proximal end 36 of the intermediate element 32 of the pole portion 18 and into the aperture 124 of the first part 122 of the yoke 120 of the pole portion maintaining apparatus 34.

The pole portion maintaining apparatus 34 in the locked position can best be seen in FIGS. 5 and 6, and as such, will be discussed with reference thereto.

When the pole portion maintaining apparatus 34 is achieving the locked position, the intermediate tongue 107 of the first edge 90 of the detent plate 84 of the pole portion maintaining apparatus 34 and the distal tongue 119 of the first edge 90 of the detent plate 84 of the pole portion maintaining apparatus 34 are biased outwardly, by the spring 132 of the pole portion maintaining apparatus 34, through the slot 136 of the proximal end 36 of the intermediate element 32 of the pole portion 18 and through a pair of adjacent ones of the plurality of slots 30 of the upper element 24 of the pole portion 18 until the straight part 100 of the detent plate 84 of the pole portion maintaining apparatus 34 contacts the inner surface of the intermediate element 32 of the pole portion 18, so that further pivoting of the detent plate 84 of the pole portion maintaining apparatus 34 is prevented.

The intermediate element 32 of the pole portion 18 is slide towards the upper element 24 of the pole portion 18 until the upper element 24 of the pole portion 18 becomes engaged in the notch 110 of the first edge 90 of the detent plate 84 of the pole portion maintaining apparatus 34, so that the intermediate element 32 of the pole portion 18 is secured to the upper element 24 of the pole portion 18 and will not disengage when force is applied.

The intermediate element 32 of the pole portion 18 is allowed to slide towards the upper element 24 of the pole portion 18 since as stated, supra, the length of the distal tongue 119 of first edge 90 of the detent plate 84 of the pole portion maintaining apparatus 34 is less than the length of each of the plurality of slots 30 of the upper element 24 of the pole portion 18.

The pole portion maintaining apparatus 34 in the unlocked position can best be seen in FIG. 8, and as such, will be discussed with reference thereto.

When the pole portion maintaining apparatus 34 is achieving the unlocked position, the intermediate element 32 of the pole portion 18 is slide away from the upper element 24 of the pole portion 18 until the upper element 24 of the pole portion 18 becomes disengaged from the notch 110 of the first edge 90 of the detent plate 84 of the pole portion maintaining apparatus 34.

The intermediate tongue 107 of the first edge 90 of the detent plate 84 of the pole portion maintaining apparatus 34 is pressed inwardly until the intermediate tongue 107 of the first edge 90 of the detent plate 84 of the pole portion maintaining apparatus 34 and the distal tongue 119 of the first edge 90 of the detent plate 84 of the pole portion maintaining apparatus 34 pass through the pair of adjacent ones of the plurality of slots 30 of the upper element 24 of the pole portion 18, so that the intermediate element 32 of the pole portion 18 is released from the upper element 24 of the pole portion 18.

The intermediate element 32 of the pole portion 18 can then be slid relative to the upper element 24 of the pole portion 18 to the desired length of the pole portion 18.

The sliding of the intermediate element 32 of the pole portion 18 relative to the upper element 24 of the pole portion 18 is facilitated if the intermediate element 32 of the pole portion 18 is twisted relative to the upper element 24 of the pole portion 18 prior to sliding, so that the detent plate 84 of the pole portion maintaining apparatus 34 does not engage with the plurality of slots 30 of the upper element 24 of the pole portion 18 during sliding.

The sliding is further facilitated by the presence of the part 106 of the first edge 90 of the detent plate 84 of the pole portion maintaining apparatus 34 which rides smoothly on the inner surface of the proximal end 36 of the intermediate element 32 of the pole portion 18.

The configuration of the transport and storage pouch 17 can best be seen in FIGS. 9 and 10, and as such, will be discussed with reference thereto.

The transport and storage pouch 17 is hollow, flexible, and preferably parallelepiped-shaped, but is not limited to that, and may be any shape and size that will conveniently transport and/or store the pole portion 18 when collapsed and the weighted handle 20 when removed from the pole portion 18 in addition to at least one additional weighted handle 20.

The transport and storage pouch 17 includes a back panel 140 that is generally rectangularly-shaped and has a back surface and a pair of long side edges and a short top edge and a short bottom edge, a pair of side panels 142 that are generally rectangularly-shaped and have a pair of short bottom edges and a pair of long front edges and extend from the pair of long side edges of the back panel 140 of the transport and storage pouch 17.

The transport and storage pouch 17 further includes a bottom panel 144 that is generally rectangularly-shaped and has a short front edge and extends from the short bottom edge of the back panel 140 of the transport and storage pouch 17 and connects the pair of short bottom edges of the pair of side panels 142 of the transport and storage pouch 17 to each other.

The transport and storage pouch 17 further includes a front panel 146 that is generally rectangularly-shaped and has an outer surface and extends from the short front edge of the bottom panel 144 of the transport and storage pouch 17 and connects the pair of long front edges of the pair of side panels 142 of the transport and storage pouch 17 to each other.

The front panel 146 of the transport and storage pouch 17 is substantially similar to the back panel 140 of the transport and storage pouch 17.

The transport and storage pouch 17 further includes a flap 148 that is generally semi-circular-shaped and has a inner surface and extends from the short top edge of the back panel 140 of the transport and storage pouch 17.

The transport and storage pouch 17 further includes a carrying strap 150 that is generally inverted U-shaped and extends from the back surface of the back panel 140 of the transport and storage pouch 17.

The transport and storage pouch 17 further includes a pair of carrying straps 151 that are generally C-shaped and extend from the lower portion of the pair of long side edges of the pouch back panel 140 of the transport and storage pouch 17.

The transport and storage pouch 17 further includes one part of hook and loop fasteners 152 disposed on the inner surface of the flap 148 of the transport and storage pouch 17 and a mating part of hook and loop fasteners 154 that is disposed on the upper portion of the outer surface of the front panel 146 of the transport and storage pouch 17.

The flap 148 of the transport and storage pouch 17 is maintained in a closed position by engaging the one part of the hook and loop fasteners 152 of the flap 148 of the transport and storage pouch 17 with the mating part of hook and loop fasteners 154 of the front panel 146 of the transport and storage pouch 17.

It is to be understood that the transport and storage pouch 17 is preferably attachable to other items, such as but not limited to, a back pack or the like, the torso of the walker 14 or the like which can be accomplished by the innovative use of the carrying strap 150 of the transport and storage pouch 17 and the pair of carrying straps 151 of the transport and storage pouch 17.

It will be understood that each of the elements described above, or two or more together, may also find a useful application in other types of constructions differing from the types described above.

While the invention has been illustrated and described as embodied in a portable telescopic weighted walking pole, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable telescopic weighted walking pole, comprising:

a) a pole portion being collapsible, telescopic, and tubular, and having a variety of lengths, so that said pole portion is length adjustable to accommodate users of different heights and can be collapsed to a small length for easy storage and transport; said pole portion including an upper element being tubular and elongated and having a proximal end, a distal end, an inner diameter, and a plurality of slots being elongated, longitudinally-oriented, spaced-apart, aligned, and having a length, and extending substantially from said proximal end of said upper element of said pole portion to substantially said distal end of said upper element of said pole portion; said pole portion further including an intermediate element being tubular and elongated and having an inner diameter and an outer diameter being substantially equal to said inner diameter of said upper element of said pole portion; said intermediate element of said pole portion further having a distal end and a proximal end being telescopically received by said distal end of said upper element of said pole portion; said intermediate element of said pole portion further having a plurality of slots being longitudinally-oriented, spaced-apart, and aligned, and having a length, and extending substantially from said proximal end of said intermediate element of said pole portion to substantially said distal end of said intermediate element of said pole portion; said plurality of slots in said intermediate element of said pole portion being alignable with said plurality of slots in said upper element of said pole portion so as to be cooperative therewith; said pole portion further including a lower element being tubular and elongated, and having a distal end, an outer diameter being substantially equal to said inner diameter of said intermediate element of said pole portion, and a proximal end being telescopically received by said distal end of said intermediate element of said pole portion;

b) maintaining means for maintaining said pole portion at a desired length; said intermediate element of said pole portion being extendable and removable from, retractable in, and maintained in relationship to, said upper element of said pole portion by said maintaining means; said lower element of said pole portion being extendable and removable from, retractable in, and maintained in relationship to, said intermediate element of said pole portion by said maintaining means; said maintaining means including a detent plate being elongated and thin and having a rounded proximal end with a lateral throughbore, a distal end, a first edge extending from said rounded proximal end of said detent plate of said maintaining means to said distal end of said detent plate of said pole portion maintaining means, and a straight second edge extending from said rounded proximal end of said detent plate of said maintaining means to said distal end of said detent plate of said maintaining means, opposite to said first edge of said detent plate of said maintaining means; said straight second edge of said detent plate of said maintaining means having a recess being substantially frustrum-shaped with a depth and a narrowest and lowest point with a center from which a first projection being substantially pointed extends outwardly from to a length less than said depth of said recess in said straight second edge of said detent plate of said maintaining means; said recess in said straight second edge of said detent plate of said maintaining means being disposed intermediate said rounded proximal end of said detent plate of said maintaining means and said distal end of said detent plate of said maintaining means; said first projection in said recess in said straight second edge of said detent plate of said maintaining means together with said recess in said straight second edge of said detent plate of said maintaining means forming a first spring seat;

c) a weighted handle being interchangeable and removably mounted to said pole portion, so that increased resistance is exerted on the arms of a user as the user walks and accomplishes dual-action exercising; and d) handle mounting means for removably mounting said weighted handle to said pole portion, so that said weighted handle can be interchanged with another said weighted handle when desired by the user and can be removed for easy storage and transport; said proximal end of said upper element of said pole portion being removably mounted to said weighted handle by said handle mounting means.

2. The pole as defined in claim 1, wherein said pole portion further includes a tip that is removably mounted to said distal end of said lower element of said pole portion.

3. The pole as defined in claim 1, wherein said weighted handle is substantially I-shaped and has a vertical portion that is substantially cylindrically-shaped with a diameter, an upper end, and a lower end; said weighted handle further has an upper horizontal portion that is substantially-disk-shaped and disposed on, is integral and coaxial with, and has a diameter greater than, said upper end of said vertical portion of said weighted handle, so that proper positioning and retention of a hand of the user on said weighted handle is facilitated; said weighted handle further has a lower horizontal portion that is substantially-disk-shaped and disposed on, is integral and coaxial with, and has a diameter greater than, said lower end of said vertical portion of said weighted handle, so that proper positioning and retention of the hand of the user on said weighted handle is facilitated.

4. The pole as defined in claim 3, wherein said weighted handle further has an outer covering that is resilient and non-corrosive and encases said weighted handle, so that said weighted handle is protected while also providing a cushion and an improved gripping surface for the hand of the user.

5. The pole as defined in claim 3, wherein said handle mounting means includes a throughbore that passes centrally and longitudinally through said lower horizontal portion of said weighted handle and into said vertical portion of said weighted handle, a distance sufficient to assure that as the hand of the user exerts force on said weighted handle, said weighted handle will not be unintentionally broken off from said pole portion.

6. The pole as defined in claim 5, wherein said throughbore in said weighted handle has a wide outer throughbore that passes longitudinally and centrally through said lower horizontal portion of said weighted handle and into said vertical portion of said weighted handle; said wide outer throughbore of said throughbore in said weighted handle has a diameter substantially equal to said outer diameter of said upper element of said pole portion; said throughbore in said weighted handle further has a narrow threaded inner throughbore that is disposed centrally and longitudinally in said vertical portion of said weighted handle and has a diameter substantially equal to said inner diameter of said upper element of said pole portion; said narrow threaded inner throughbore of said throughbore in said weighted handle is coaxial and in communication with, and is narrower than, said wide outer throughbore of said throughbore in said weighted handle.

7. The pole as defined in claim 6, wherein said handle mounting means further includes a throughbore that passes laterally through said proximal end of said upper element of said pole portion.

8. The pole as defined in claim 7, wherein said handle mounting means further includes a plug that is cylindrically-shaped and has a threaded upper portion that is cylindrically-shaped and has a diameter substantially equal to said diameter of said narrow threaded inner throughbore of said throughbore in said weighted handle; said plug of said handle mounting means further has a lower portion that is cylindrically-shaped and coaxial with said threaded upper portion of said plug of said handle mounting means; said lower portion of said plug of said handle mounting means sits in, and has a diameter substantially equal to said inner diameter of, said proximal end of said upper element of said pole portion; said lower portion of said plug of said handle mounting means has a throughbore that passes laterally therethrough and is in alignment with said throughbore in said proximal end of said upper element of said pole portion.

9. The pole as defined in claim 8, wherein said handle mounting means further includes a pin that passes through said throughbore in said proximal end of said upper element of said pole portion and through said throughbore in said lower portion of said plug of said handle mounting means, so that said plug of said handle mounting means is maintained in said proximal end of said upper element of said pole portion; said threaded upper portion of said plug of said handle mounting means threadably mates with said narrow threaded inner throughbore of said throughbore in said weighted handle with said proximal end of said upper element of said pole portion received by said wide outer throughbore of said throughbore in said weighted handle when said weighted handle is threaded onto said pole portion.

10. The pole as defined in claim 1, wherein said first edge of said detent plate of said maintaining means has a proximal straight part that extends from, and is above, said rounded proximal end of said detent plate of said maintaining means; said proximal straight part of said first edge of said detent plate of said maintaining means is connected to said rounded proximal end of said detent plate of said maintaining means by a concave part.

11. The pole as defined in claim 10, wherein said first edge of said detent plate of said maintaining means further has a first intermediate straight part that extends slightly upwardly from said proximal straight part of said first edge of said detent plate of said pole portion maintaining means; said first intermediate straight part of said first edge of said detent plate of said maintaining means is connected to said proximal straight part of said first edge of said detent plate of said maintaining means by a proximal convex part; said first intermediate straight part of said first edge of said detent plate of said maintaining means is disposed on said first edge of said detent plate of said maintaining means in a position substantially opposite to where said recess in said straight second edge of said detent plate of said maintaining means is disposed; said first edge of said detent plate of said maintaining means further has a substantially semicircular part that has a radius of curvature and extends downwardly in a convex configuration from said first intermediate straight part of said first edge of said detent plate of said maintaining means; said proximal convex part of said first edge of said detent plate of said maintaining means, said first intermediate straight part of said first edge of said detent plate of said maintaining means, and said substantially semi-circular part of said first edge of said detent plate of said maintaining means together form an intermediate tongue that has a length; said length of said intermediate tongue of said first edge of said detent plate of said maintaining means is slightly greater than said length of each of said plurality of slots in said upper element of said pole portion and is slightly greater than said length of each of said plurality of slots in said intermediate element of said pole portion.

12. The pole as defined in claim 11, wherein said first edge of said detent plate of said maintaining means further has a first connecting straight part with a length and extends downwardly from said substantially semi-circular part of said first edge of said detent plate of said maintaining means and forms therewith a notch; said length of said first connecting straight part of said first edge of said detent plate of said maintaining means is slightly greater than the difference between said inner and outer diameters of said upper element of said pole portion and is slightly greater than the difference between said inner and outer diameters of said intermediate element of said pole portion; said first edge of said detent plate of said maintaining means further has a second intermediate straight part that extends from said first connecting straight part of said first edge of said detent plate of said maintaining means and is disposed below said substantially semi-circular part of said first edge of said detent plate of said maintaining means; said first edge of said detent plate of said maintaining means further has a second connecting straight part with a length and extends upwardly from said second intermediate straight part of said first edge of said detent plate of said maintaining means; said length of said second connecting straight part of said first edge of said detent plate of said maintaining means is greater than the difference between said inner and outer diameters of said upper element of said pole portion and is greater than the difference between said inner and outer diameters of said intermediate element of said pole portion; said first connecting straight part of said first edge of said detent plate of said maintaining means, said second intermediate straight part of said first edge of said detent plate of said maintaining means, and said second connecting straight part of said first edge of said detent plate of said maintaining means together define a recess with a length and opens into, and is in communication with, said notch in said first edge of said detent plate of said maintaining means; said length of said recess in said first edge of said detent plate of said maintaining means is greater than the distance between adjacent ones of said plurality of slots in said upper element of said pole portion and is greater than the distance between adjacent ones of said plurality of slots in said intermediate element of said pole portion by an amount substantially equal to said radius of curvature of said substantially semi-circular part of said first edge of said detent plate of said maintaining means.

13. The pole as defined in claim 12, wherein said first edge of said detent plate of said maintaining means further has a distal straight part that extends slightly downwardly from said second connecting straight part of said first edge of said detent plate of said maintaining means to said distal end of said detent plate of said maintaining means; said distal straight part of said first edge of said detent plate of said maintaining means is connected to said second connecting straight part of said first edge of said detent plate of said maintaining means by a distal convex part; said second connecting straight part of said first edge of said detent plate of said maintaining means, said distal straight part of said first edge of said detent plate of said maintaining means, and said distal end of said detent plate of said maintaining means together form a distal tongue with a length; said length of said distal tongue of said first edge of said detent plate of said maintaining means is less than said length of each of said plurality of slots in said upper element of said pole portion and is less than said length of each of said plurality of slots in said intermediate element of said pole portion.

14. The pole as defined in claim 11, wherein said maintaining means further includes a slot that is elongated and longitudinally-oriented, has a length, and is disposed in each of said lower element of said pole portion and said intermediate element of said pole portion, in proximity to said proximal end of each thereof; said length of said slot in each of said lower element of said pole portion and said intermediate element of said pole portion is greater than the distance from said proximal convex part of said first edge of said detent plate of said maintaining means to said distal end of said detent plate of said maintaining means.

15. The pole as defined in claim 14, wherein said first end of said spring of said maintaining means sits on a second spring seat disposed on said inner surface of each of said intermediate element of said pole portion and said lower element of said pole portion, in generally opposing alignment with said first spring seat in said recess in said straight second edge of said detent plate of said maintaining means, and is maintained therein by a second projection that is centrally-disposed and substantially pointed.

16. The pole as defined in claim 1, wherein said maintaining means further includes a yoke that is cylindrically-shaped and mounted in each of said lower element of said pole portion and said intermediate element of said pole portion, in proximity to said proximal end of each thereof; said yoke of said maintaining means has a first part that is cylindrically-shaped with an aperture that is laterally-disposed and an outer surface; said yoke of said maintaining means further has a pair of extensions that are spaced-apart and substantially semi-circular-shaped, have curved sides, and define therebetween a throughslot; said pair of extensions of said yoke of said maintaining means extend longitudinally outwardly from said first part of said yoke of said maintaining means with said curved sides of said pair of extensions of said yoke of said maintaining means in alignment and continuous with said outer surface of said first part of said yoke of said maintaining means; said pair of extensions of said yoke of said maintaining means has a throughbore that is laterally-disposed and extends aligningly therethrough; said rounded proximal end of said detent plate of said maintaining means sits in said throughslot between said pair of extensions of said yoke of said maintaining means with said throughbore in said pair of extensions of said yoke of said maintaining means in alignment with said lateral throughbore in said rounded proximal end of said detent plate of said maintaining means.

17. The pole as defined in claim 16, wherein said maintaining means further includes a pivot pin that passes through said throughbore in said pair of extensions of said yoke of said maintaining means and through said lateral throughbore in said rounded proximal end of said detent plate of said maintaining means, so that said detent plate of said maintaining means is pivotally mounted to said yoke of said maintaining means.

18. The pole as defined in claim 1, wherein said maintaining means further includes a spring that has a first end and a second end that sits in, and extends outwardly from, said first spring seat in said recess in said straight second edge of said detent plate of said maintaining means; said spring of said maintaining means surrounds, and is maintained in position by, said first projection in said recess in said straight second edge of said detent plate of said maintaining means.

19. The pole as defined in claim 1; further comprising a transport and storage pouch for storing and transporting said pole portion when collapsed and said weighted handle when removed from said pole portion.

20. The pole as defined in claim 19, wherein said transport and storage pouch is hollow, flexible, and generally parallelepiped-shaped, and is of a size that will conveniently transport and store said pole portion when collapsed and said weighted handle when removed from said pole portion; said transport and storage pouch has a back with a pair of long sides from which extend a pair of generally C-shaped carrying straps, and a top from which extends an inverted generally U-shaped carrying strap, a flap with an inner surface on which is disposed a part of hook and loop fasteners, a front with an outer surface on which is disposed a mating part of hook and loop fasteners that are engagable with said hook and loop fasteners on said inner surface of said flap.

* * * * *